US005323922A

United States Patent [19]

Lapoint, Jr. et al.

[11] Patent Number: 5,323,922

[45] Date of Patent: Jun. 28, 1994

[54] COLLAPSIBLE CONTAINMENT SYSTEM

[76] Inventors: John H. Lapoint, Jr., 32 Atlantic Dr., Scarborough Beach, Scarborough, Me. 04074; John H. Lapoint, III, P.O. Box 297, Kennebunk, Me. 04043

[21] Appl. No.: 31,269

[22] Filed: Mar. 15, 1993

Related U.S. Application Data

[63] Continuation-in-part of Ser. No. 774,622, Oct. 10, 1991, Pat. No. 5,209,364.

[51] Int. Cl.[5] ..... B65D 25/14

[52] U.S. Cl. ..... 220/4.28; 220/4.29; 220/461; 220/464; 220/6; 383/119; 383/104

[58] Field of Search ..... 220/6, 4.29, 461, 651, 220/464, 4.23, 403, 416, 463, 462, 1.5, 908, 909, 904, 4.28, 528; 383/119, 104, 109

[56] References Cited

U.S. PATENT DOCUMENTS

| | | | |
|---|---|---|---|
| 3,896,991 | 7/1975 | Kozlowski et al. | 383/119 |
| 4,865,218 | 9/1989 | Derby et al. | 220/461 |
| 4,867,328 | 9/1989 | McCarthy | 220/909 |
| 4,901,885 | 2/1990 | Boots | 220/402 |
| 4,903,859 | 2/1990 | Derby et al. | 220/462 |
| 5,158,369 | 10/1992 | Derby | 383/104 |
| 5,209,364 | 5/1993 | Lapoint, Jr. | 383/104 |

*Primary Examiner*—Allan N. Shoap
*Assistant Examiner*—S. Castellano
*Attorney, Agent, or Firm*—Frederick R. Cantor

[57] ABSTRACT

A collapsible, bag-like container, that incorporates the features of a rigid, free-standing container, with the flexibility and collapsibility of a bulk bag. Stiffening members are placed into pockets, created by sewing together two sheets of woven polypropylene. The stiffening members may be removed and placed inside the bag for shipping, and then installed in the sewn pockets to create a collapsible container, suitable for containment, and shipment, of bulk materials of up to seventy (70) percent liquid composition. The container side walls have flaps that can be folded onto the top of the container, and tied together with flexible tie elements, such that the container has a desired transverse reinforcement.

1 Claim, 7 Drawing Sheets

COLLAPSIBLE CONTAINMENT SYSTEM

CROSS REFERENCE TO RELATED PATENT APPLICATION

This Application is a Continuation-in-Part Application of the U.S. Patent Application, entitled "Collapsible Containment System", Ser. No. 07/774,622, filed on Oct. 10, 1991 now U.S. Pat. No. 5,209,364.

BACKGROUND OF THE PRESENT INVENTION

The present invention relates, to a collapsible bulk storage containment system, that has the rigid features of a fiber board box, along with the flexibility, or collapsibility, and liquid integrity, of a bulk bag.

Previously manufactured bulk shipping containers have usually used either a bag approach, or a rigid container approach, both of which have their advantages and their disadvantages. The bag type containers are easily shipped, and stored, in an empty condition, but frequently they generally do not have sufficient rigidity, especially when filled with liquid, or fluent material, to allow stacking of the filled containers.

They also have presented problems in loading, and particularly, in unloading, in that they can easily shift during transport, making it substantially impossible to unload them with mechanical devices, such as fork lifts, without penetrating the bags. The rigid containers clearly have sufficiently rigid structure to allow stacking, when filled, or partially filled, with liquid, or fluent material, but they cannot be collapsed, and thus take up a lot of room for transportation and storage when empty. Many of the known bag and rigid containers do not have any provision for compartmentalization of the storage region, in order to provide for multiple materials to be loaded in the container in a segregated fashion.

One recent attempt to overcome the above-mentioned difficulties is found in U.S. Pat. No. 4,903,859, issued to N. C. Derby et al. This Patent, discloses a bag-like container, which is made from two-layers of flexible material, which form a series of pockets therebetween. At least two rigid members are inserted into these pockets, to form opposing rigid side walls, when the container is assembled. Access spouts are provided for filling, or discharging, liquid contents. The top and bottom of the container are closed by excess material, there being no top and bottom members, or portions, as such. A somewhat similar approach is found in U.S. Pat. No. 3,896,991.

In the bag-like container, depicted in U.S. Pat. No. 4,903,859, the ends of the container are formed by tubular plastic sheet sections, that extend axially beyond the ends of the rigid stiffening members contained within pockets in the container side walls. The tubular plastic sheet sections are collapsed together on the container central axis, after which flexible ties are tightened around the collapsed sheet sections. The process is quite similar to the process used to close the mouth of a conventional trash bag. The patentees, [N.C. Derby et al.], indicate that the collapsed sheet sections at the opposite ends of the container are access spouts, for adding liquid to the container, or withdrawing liquid from the container.

One problem with the bag-like container of U.S. Pat. No. 4,903,859 is that the tied, collapsed plastic end sections, contribute very little transverse rigidity to the container. The container is not very stable when placed upright on a flat surface, since any lateral offsetting of the container center of gravity from the container central axis, can allow the container to tilt, or possibly topple over. Also, when the container is placed on a flat support surface, the lowermost tied collapsed plastic end section in contact with the support surface, will, inevitably, be forced upwardly into the space circumscribed by the rigid container side walls, thereby generating a stress on the flexible tie, that is tightened around the collapsed plastic end section. In this circumstance, there is a potential danger that the flexible tie will break, or become loosened, so as to produce a leaking condition, at the lower end of the bag-like container.

SUMMARY OF THE PRESENT INVENTION

The object of the present invention is to provide a collapsible bulk storage containment system, that has the rigid features of a fiber board box, along with the flexibility, or collapsibility, and liquid integrity, of a bulk bag.

The present invention discloses a containment system for transporting fluent materials. The containment system, has the rigid features of a fiberboard box, and the flexibility and collapsibility of a bulk bag. In one preferred embodiment, the containment system has a plurality of wall assemblies, each formed from inner and outer layers of flexible liquid-proof material, joined along three edges, to define a pocket therebetween. A stiffening member is sealed in the pocket on the fourth side, with the inner layer extending to form a loading chute/closure and the outer layer extending to form a closure flap. The side assemblies are closed at their lower ends by a double wall bottom of the same material as the side wall layers. A cover member may be provided to close the container, by engagement with the closure flaps.

An important feature of the present invention, is the flaps at the upper ends of the container side walls. These flaps can be swung inwardly, to occupy a horizontal plane, in near proximity to the overlying cover member. Flexible tie members can be extended through aligned grommet openings in the flaps and cover member, whereby the flaps and cover member, are rigidly locked together, so as to give the bag-like container some transverse rigidity, or reinforcement. Additionally, the cover member provides an essentially flat upper surface, suitable for stacking a second container thereon.

In a further embodiment of the present invention, the bag-like container uses the flaps as a cover for the container upper end, and the extra cover member is not used. Two of the flaps are swung inwardly from opposite side walls of the container, so as to form a relatively rigid cover. Flexible tie elements are extended through grommet openings in the flaps, whereby the flaps are rigidly tied together. Two other flaps, attached to other ones of the container side walls, are swung inwardly, to overlie the first-mentioned flaps. These other flaps are rigidly connected together by additional flexible tie elements, extended through grommet openings in the respective flaps. The last-mentioned flaps form a second, relatively rigid, cover, that provides an additional rigidifying effect, over and beyond the rigidifying action of the first cover. The various flaps are placed in tension, so as to retain the container side walls, in their intended angular relationships. The rigid container side walls are kept upright, and at a desired right angular position, such that, the bag-like container has a reduced tendency to topple, or collapse, in the sidewise direction.

In summary, and in accordance with the above discussion, the foregoing objectives are achieved in the following embodiments.

1. A collapsible containment system for handling materials having a non-stable consistency, such as a slurry, said containment system comprising:

a container having at least four upstanding side walls assemblies, joined to each other along their adjacent side edges, each said side wall assembly, having inner and outer layers of flexible liquid-proof material, joined along three edges, thereof, defining a pocket therebetween;

each said inner layer, having a greater vertical length that the associated outer layer, whereby the inner layers, collectively form a loading sleeve;

each said outer layer, having an upper edge, and a flap, swingably attached to each outer layer at its upper edge;

each flap having a first plurality of grommets spaced therealong, in a patterned array;

a relatively rigid stiffening member, positioned in each respective pocket of each said side wall assembly;

a bottom wall, joined to a lower edge of each said side wall assembly, so that said bottom wall and said side wall assemblies, collectively, define a material receiving cavity; and a top member, having a second plurality of grommets, spaced along the periphery thereof, each said second grommet, being aligned with a respective grommet, on an associated flap, for attachment of said top member to said flaps.

2. A collapsible containment system, as described in paragraph 1, and further comprising, hold-down tabs, attached to, and extending outwardly of, said side wall assemblies, adjacent said bottom wall.

3. A collapsible containment system, as described in paragraph 1, and further comprising, lifting means, secured to said side wall assemblies, adjacent the upper edges thereof.

4. A collapsible containment system, as described in paragraph 1, wherein said liquid-proof material is polypropylene.

5. A collapsible containment system, as described in paragraph 1, wherein said stiffening members are formed from a triple wall material.

6. A collapsible containment system, as described in paragraph 1, and further comprising, a form-fitting, removable, inner liner, seatable within the cavity defined by said bottom wall and said side wall assemblies.

7. A collapsible containment system, as described in paragraph 1, and further comprising, removable compartment means, seatable within said cavity.

8. A collapsible containment system, as described in paragraph 7, and further comprising, a plurality of removable liners, conforming to said removable compartment means.

9. A collapsible containment system, as described in paragraph 1, and further comprising, a flexible tensionable tie means, extendable through aligned grommets, in the top member and associated flaps, whereby the flaps are locked to the top member, via said tie means.

10. A collapsible containment system, as described in paragraph 9, wherein each flap has two grommets, spaced a substantial distance apart, whereby said first grommets are located near the vertical corners of the container; and each flexible tie means, being extendable, through two grommets, in the top member and two aligned grommets, in two associated flaps.

11. A collapsible container for flowable materials, comprising, a bottom wall, having a plurality of side edges, and a plurality of upstanding side walls extending upwardly from the edges of said bottom wall, to form an upwardly open container;

said bottom wall and said side walls, being formed of flexible materials, impervious to liquid flow therethrough;

each side wall comprising, an inner layer of flexible material and an outer layer of flexible material; said inner and outer layers, being joined together only along selected edges thereof, so as to form a pocket therebetween;

a relatively rigid stiffening panel, located in each pocket;

each rigid panel having a face area, that is only slightly less than the face area of the associated side wall, whereby each side wall is rendered substantially, nonflexible because of the presence of the associated panel;

each outer layer having an upper edge;

a flexible flap integrally joined to each outer layer at its upper edge, whereby each flap can be swung from a first position, extending downwardly along the outer surface of the associated side wall, to a second position, extending horizontally inwardly toward the container central axis; and tensioned tie means, trained between selected flaps when said flaps are in their second positions, whereby said flaps maintain the side walls, in pre-determined angular relationships.

12. The container, as described in paragraph 11, wherein each flap has a free edge extending parallel to the upper edge of the associated outer layer; and said flaps being dimensioned, so that when the flaps are in their second positions, the free edges of two opposed flaps are relatively close together.

13. The container, as described in paragraph 12, wherein each flap has at least two grommets thereon, in near proximity to its free edge; said tensioned tie means comprising individual flexible tie elements extending through the grommets on opposed ones of the flaps.

14. The container, as described in paragraph 11, wherein there are four upstanding side walls, arranged at right angles so that the container has a cubic configuration;

each flap having a free edge extending parallel to the upper edge of the associated outer layer on a given side wall;

a first two of said flaps being swingable toward each other to extend in a first lower horizontal plane;

the other two flaps being swingable toward each other to extend in a second upper horizontal plane;

each flap having at least two grommets thereon in near proximity to its free edge; and said tensioned tie means comprising first individual tie elements extending through the grommets on the flaps located in said lower horizontal plane, and second individual tie elements extending through the grommets on the flaps located in said upper horizontal plane.

15. The container, as described in paragraph 14, wherein the flaps are dimensioned so that when said first two flaps are swung toward each other their free edges are abutted together.

16. The container, as described in paragraph 15, wherein the flaps are dimensioned so that when said other two flaps are swung toward each other, their free edges abut together.

BRIEF DESCRIPTION OF THE DRAWINGS

The present invention will now be described, by way of example, with reference to the accompanying drawings in which.

DETAILED DESCRIPTION OF THE PREFERRED EMBODIMENTS OF THE PRESENT INVENTION

Figure 1:
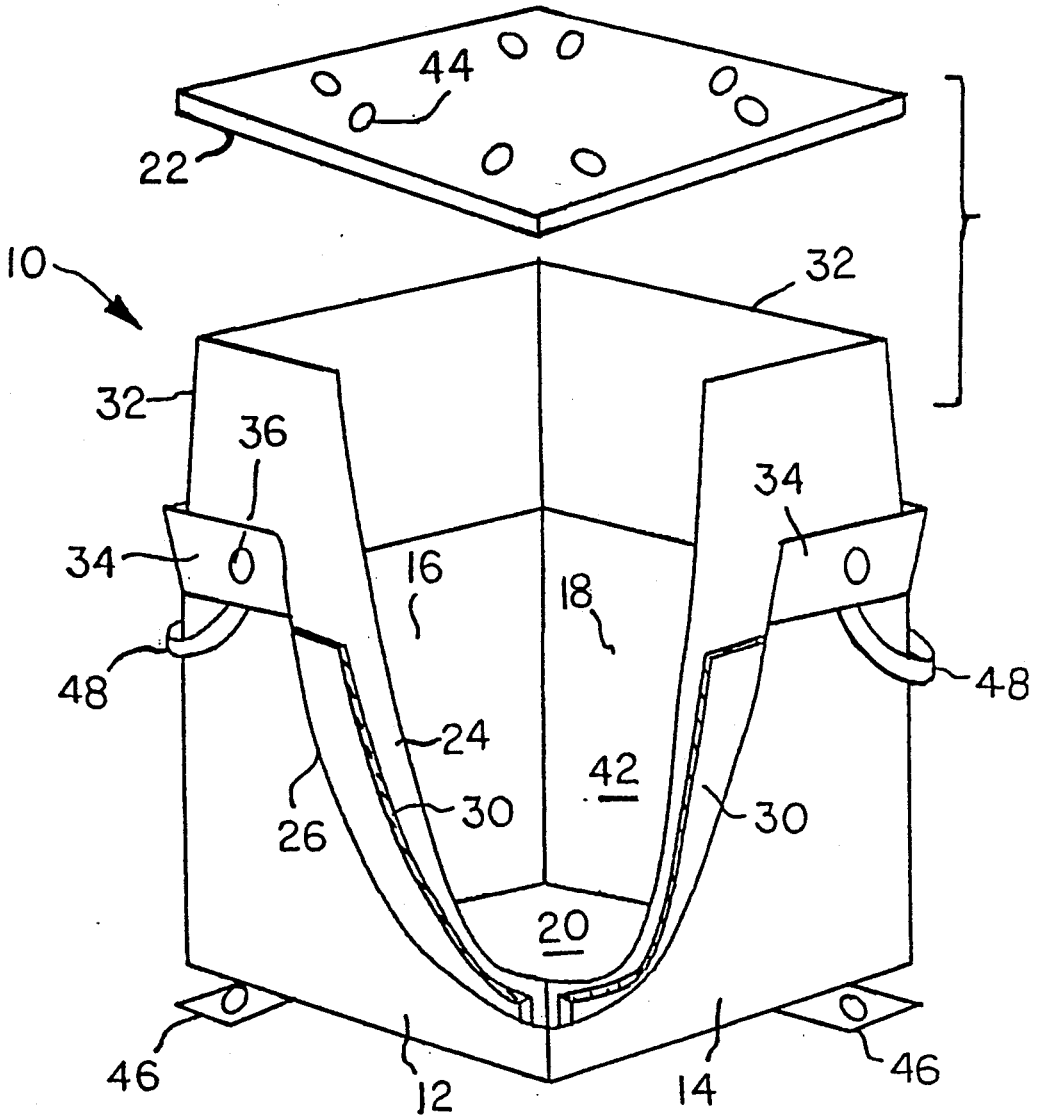
FIG. 1, is a partially exploded diagrammatic perspective view, partially broken away, and in section, showing a container of the present invention, in an opened condition, ready for loading.

FIG. 1, is a partially exploded diagrammatic perspective view, partially broken away, and in section, showing a container of the present invention, in an opened condition, ready for loading.

Figure 2:
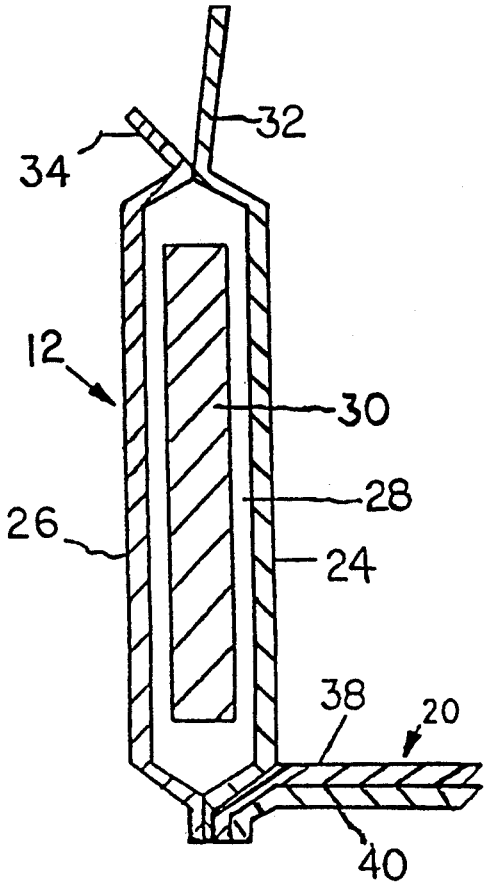
FIG. 2, is a fragmentary, vertical sectional view, taken through a side wall assembly, used in the FIG. 1 container.
Figure 3:
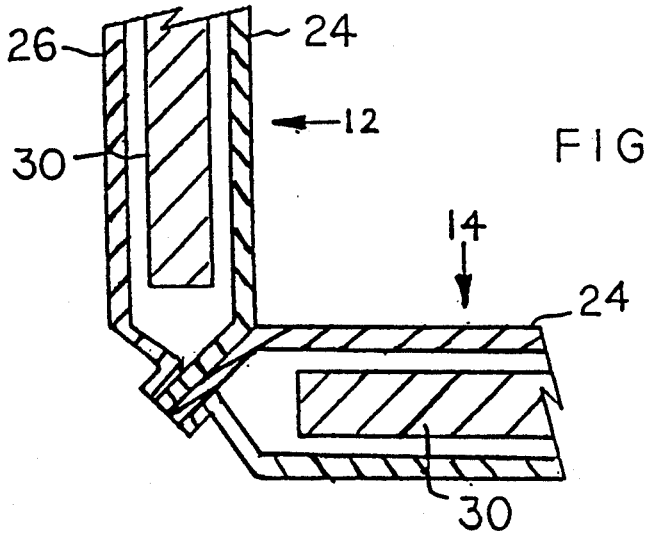
FIG. 3, is fragmentary, horizontal, sectional view, taken through a corner of the FIG. 1 container.
Figure 4:
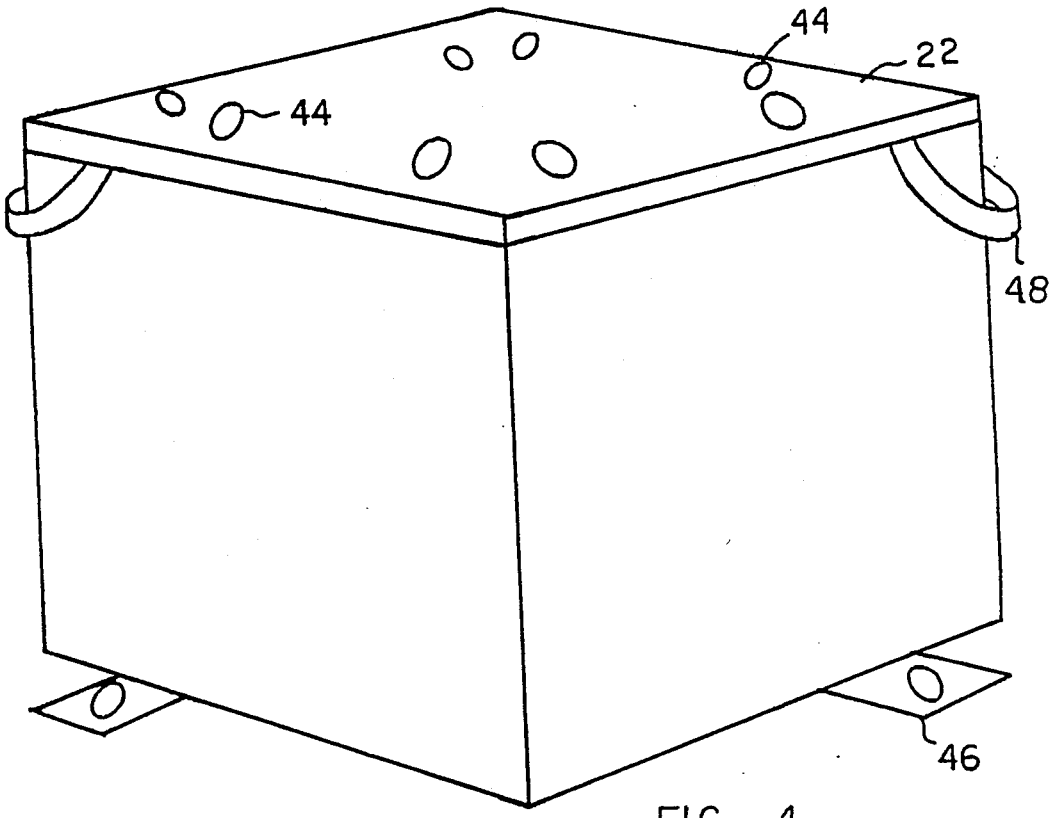
FIG. 4, is a diagrammatic perspective view, of the FIG. 1 container, in a loaded, and closed, condition.

FIG. 2, is a fragmentary, vertical sectional view, taken through a side wall assembly, used in the FIG. 1 container.

One preferred embodiment of the present invention, is shown in FIG. 1, in a diagrammatic perspective, with parts broken away to expose the interior of the container. The FIG. 1 container 10, has been shown with a generally cubic shape, having side wall assemblies 12, 14, 16, 18, bottom wall 20, and cover member 22. The wall assemblies, as also shown in FIG. 2, are preferably fabricated of inner and outer layers of woven liquid tight, or liquid-proof, material 24 and 26, such as polypropylene. The layers of each wall assembly are joined at three of their lateral edges by sewing, or fusing, (not shown), forming pockets 28, therebetween. A relatively rigid stiffening panel member 30, is inserted into each side wall pocket. The stiffening panel member 30, is preferably formed from rigid plastic, fiber board, triple wall, or similar material, and is inserted into the pockets, to ensure the structural rigidity of the filled containment system. The two layers 24, and 26, are joined together above the stiffening member, with the inner layer continuing to form a component part of the closure, or inner cover flap, designated generally by numeral 32. Outer layer 26, forms a somewhat shorter outer closure flap 34, that is provided with a spaced array of grommets 36. The bottom wall 20, is preferably formed of a double layer, 38 and 40, of the same flexible material as the side wall assemblies. The peripheral edges of bottom wall 20, may be secured to the respective lower edges of the side wall assemblies, in the same fashion as the side wall assemblies are joined together. The side wall assemblies and the bottom wall, form the container, and define therewithin a material receiving cavity 42.

The cover member 22, is substantially the same size as the bottom wall 20, and is provided near its periphery with a spaced array of grommets 44, each aligned with a respective grommet 36, of the side wall flaps. The cover member can be either rigid, or flexible, and preferably, is formed from the same material as the rest of the container.

The subject container may further be provided with a plurality of tie down means 46, in spaced array along the container lower edge. These can be used to secure the subject container to a pallet, which is not shown. Similarly, a plurality of lifting loops 48, can be provided at the container upper edge, preferably adjacent the corners where the loops will be out of the way during filling and emptying of the container. Lifting loops 48, are most useful when moving the filled container. These loops 48, will allow the subject container to be gripped, and lifted, by mechanical means, such as a fork lift.

Figure 8:
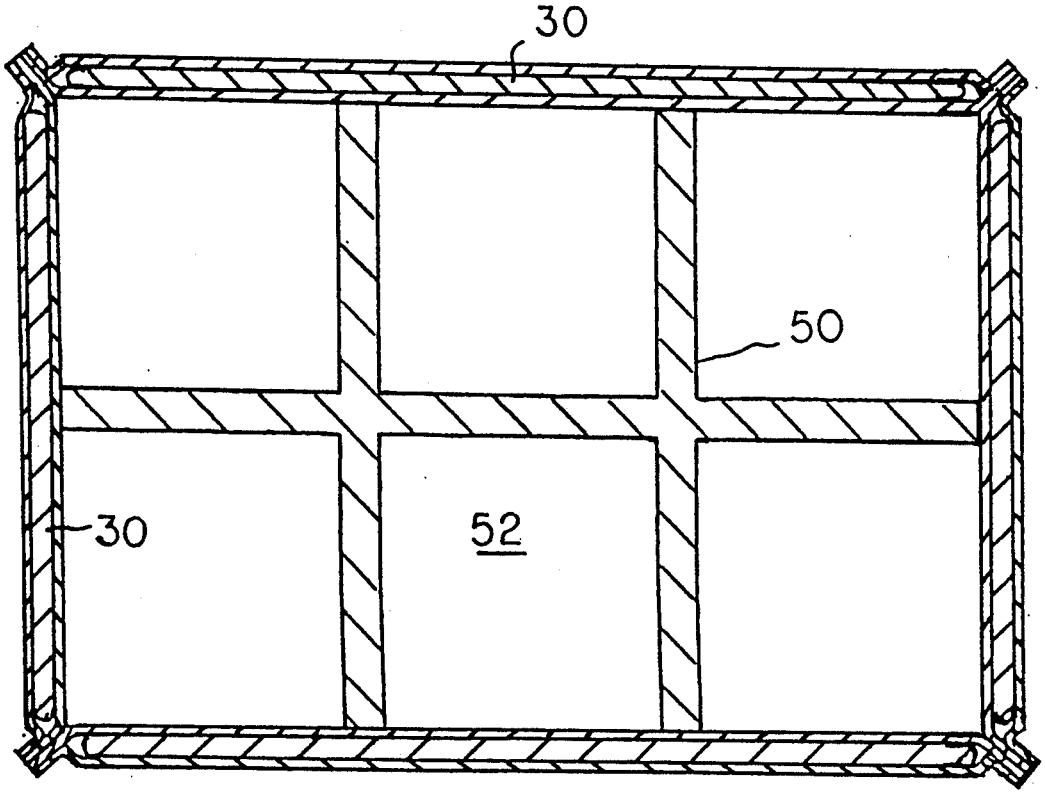
FIG. 8, is a sectional view, taken through another container, constituting an alternate embodiment of the present invention. The depicted container allows segregated materials, to be placed in a single container.

FIG. 8, is a sectional view, taken through another container, constituting an alternate embodiment of the present invention. The depicted container allows segregated materials, to be placed in a single container.

The present invention may be provided with an inner liner, not shown, which is, preferably, form-fitting within the material receiving cavity 42. The container may also be provided with an egg-crate type insert 50, as shown in FIG. 8, forming separate compartments 52, within the container 10. Each compartment 52, then receives therein a flexible bag, not shown, filled with a material to be segregated from the other materials in the container.

Figure 7:
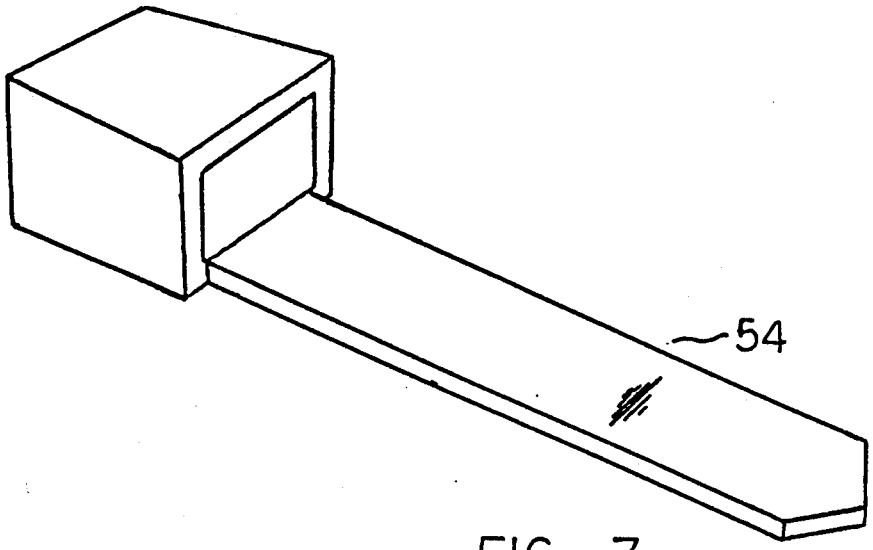
FIG. 7, is a perspective view, of a flexible tie of the type that can be used in practice of the present invention.

FIG. 7, is a perspective view, of a flexible tie of the type that can be used in practice of the present invention.

Once the container is filled, the inner cover flap 32, is closed, and collapsed upon itself, and tied with a flexible tie means 54, thus ensuring that the contents of the material receiving cavity 42, cannot escape, or leak out. The contents of the container 10, are further protected by closing and joining the cover member 22, to the outer cover flaps 34, by means of additional tie means 54, passing through the respective grommets 36, 44. The tie means 54, as shown in FIG. 7, may be any one of the many readily available one-way flexible ties currently available from multiple sources. They generally have an elongated plastic tail portion, extending from a body having a through passage. The tail is wrapped around the object to be secured, and inserted through the passage where it is secured against withdrawal.

Figure 9:
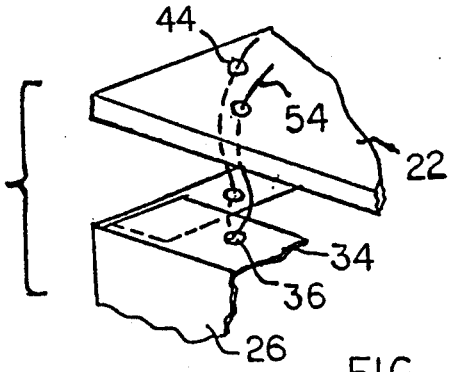
FIG. 9, is a fragmentary perspective view, of the FIG. 1 container and cover, and illustrating a flexible tie means that can be used to connect the cover with flaps at the upper edge of the container.

FIG. 9, is a fragmentary perspective view, of the FIG. 1 container and cover and illustrating a flexible tie means that can be used to connect the cover with flaps at the upper edge of the container.

FIG. 9, shows the general relationship between the grommets 44, on cover member 22, and the grommets 36, on an outer flap 34, while a flexible tie element 54, is being threaded through the aligned grommet openings. Each outer flap 34, has two grommets 36, spaced a substantial distance apart, such that the grommets are located near the vertical corners of the container. The grommet arrangement depicted in FIG. 9, is representative of the grommet arrangement at the other corners of the container. As shown pictorially, in FIG. 9, the flexible tie elements 54, can be extended downwardly through one set of aligned grommet openings, and upwardly through the other set of grommet openings, in a U-shaped configuration. When the various tie elements have been threaded through the various grommet openings, the cover member 22 can be lowered onto the upper edge of the container, and the tie elements tightened to lock the cover member to the various outer flaps 34.

The tightened tie elements are located in planes, running diagonally across the container corners. The tie elements thus tend to act somewhat like gussets to keep the corners square. By keeping the four corners of the container square, the container cubic shape is maintained. even though the container is a bag-like structure, formed to a large extent out of flexible lightweight materials. Cover member 22, spans the various outer flaps 34, to rigidify the container and prevent the container from toppling, or shifting sideways, under the weight of the liquids within the container. Tie elements 54, can take various forms, e.g., the telescopic construction shown in FIG. 7, or a conventional twisted wire configuration.

Figure 5:
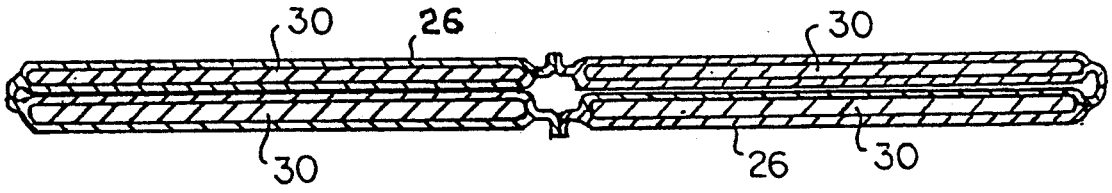
FIG. 5, is a sectional view, taken through the FIG. 1 container, collapsed, or folded, upon itself for storage purposes.

FIG. 5, is a sectional view, taken through the FIG. container, collapsed, or folded, upon itself for storage purposes.

The present invention utilizes a panel pocket construction to provide a collapsible container, which may be collapsed for storage, or shipment, when empty. When it is desired to collapse the empty container, for storage or shipping, the container is collapsed upon itself, as shown in FIG. 5, so that the container may be shipped in a flattened condition.

As shown in FIG. 5, two of the container side walls are flattened, so as to be parallel with the other two side walls, such that the container has a flat, slab-like configuration, adapted for compact storage or shipment. The bottom wall 20, of the container is not shown, but would, in practice, fold up at one end of the folded construction.

Figure 6:
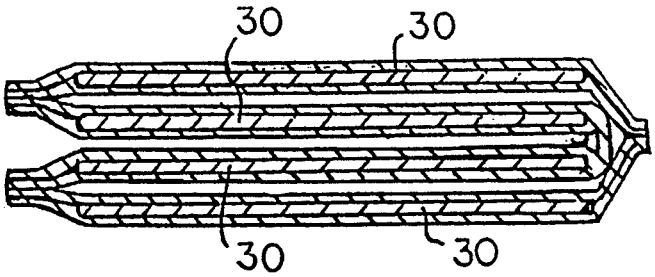
FIG. 6, is another sectional view, showing another configuration that the FIG. 1 container could possibly take, in a collapsed and folded condition.

FIG. 6, is another sectional view, showing another configuration that the FIG. 1 container could possibly take, in a collapsed and folded condition.

FIG. 6, depicts a further configuration that the container might have, depending on the amount of flexible material that might be available for folding one container section on another container section. FIG. 6, is essentially the FIG. 5 configuration, but folded in half, in order to double one-half of the construction back on the other half.

FIG. 8, shows an alternate embodiment of the present invention, that comprises a collapsible container that has an egg-crate type insert 50, for allowing formation of separate compartments within the container, to isolate the contents. The configuration of the insert is dependent upon the number of different materials that must be separated. If the container is compartmentalized, each compartment may have a form-fitting liner, or bag (not shown), installed therein. Once filled, each liner, or bag, is closed with a one-way tie, much in the same manner as the closure of the primary container. The cover member (not shown), is placed on the container and secured thereto using one-way ties placed through the grommets on the cover member and closure flaps.

The container of the present invention further has loop-type handles 48, disposed on the upper corners of the container, in such a manner, that the assembled and filled container may be lifted and carried by mechanical means, such as a fork lift. The container further has hold-down tabs 46, disposed along the bottom edge, so that the container may be attached to a fixed shipping means, such as a pallet. Corner sleeves, not shown, may be installed to add rigidity and protection for the corners, and to further make possible the stacking of multiple containers.

The subject container is moisture and water resistant, so that it may be filled with bulk materials having a consistency of up to seventy (70) percent liquid sludge.

Figure 10:
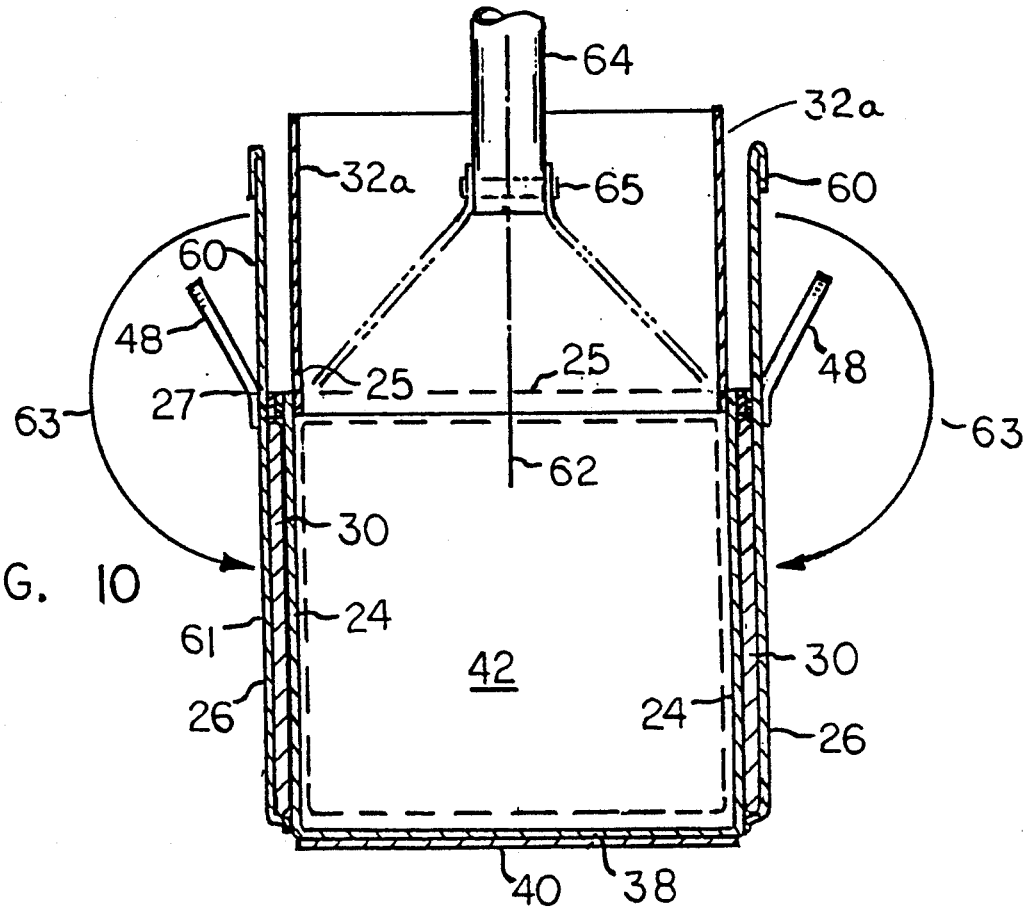
FIG. 10, is a sectional view, taken through another container embodiment, embodying features of the present invention.

FIG. 10, is a sectional view, taken through another container embodiment, embodying features of the present invention.

Figure 11:
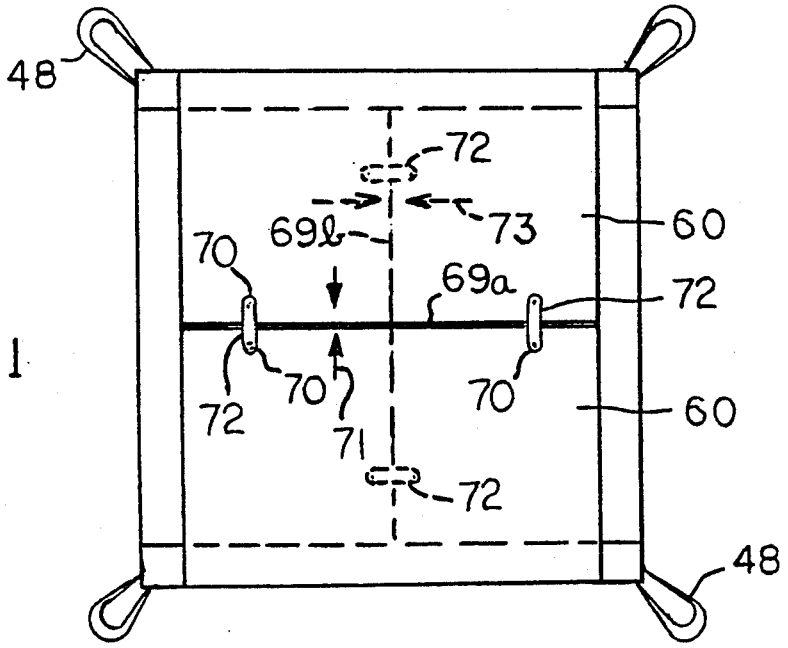
FIG. 11, is a top plan view, of the FIG. 10 container, with the container flaps swung down to their closed positions.

FIG. 11, is a top plan view, of the FIG. 10 container, with the container flaps swung down to their closed positions.

Figure 12:
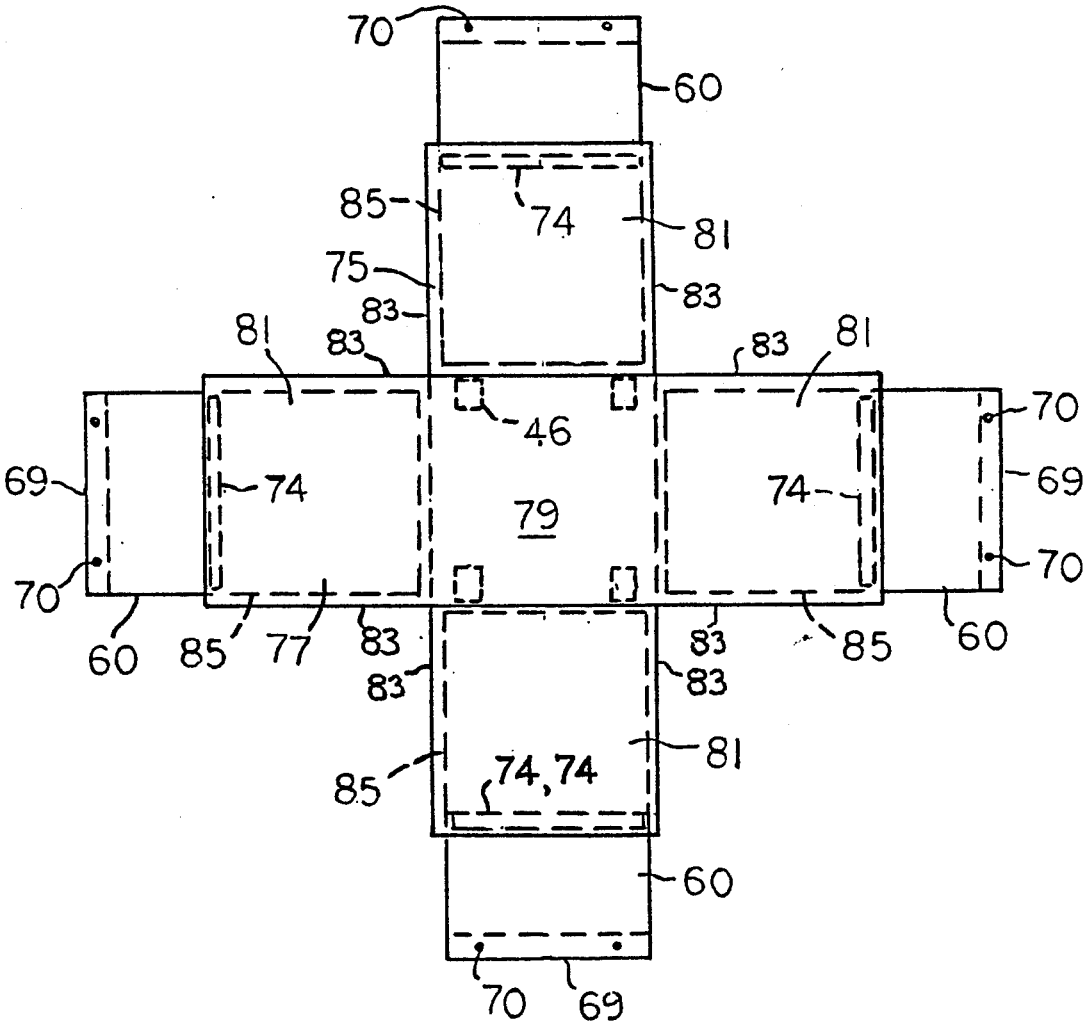
FIG. 12, is a plan view, of a blank fabric assembly, that can be used to form the FIG. 10 container.

FIG. 12, is a plan view, of a blank fabric assembly, that can be used to form the FIG. 10 container.

FIGS. 10 through 12, illustrate a container construction that is, in many respects, similar to the container of FIG. 1. However, in the FIG. 10 container, a sleeve, 32*a*, is separately formed from the liner side walls. As shown in FIG. 10, the upper edge of each container side wall inner layer 24, has an upper edge 25, located slightly above the upper edges of the stiffening panel members 30. The flexible fabric sleeve 32*a*, is sewn, or otherwise affixed, to the various inner layers 23, near upper edges 25.

Figure 13:
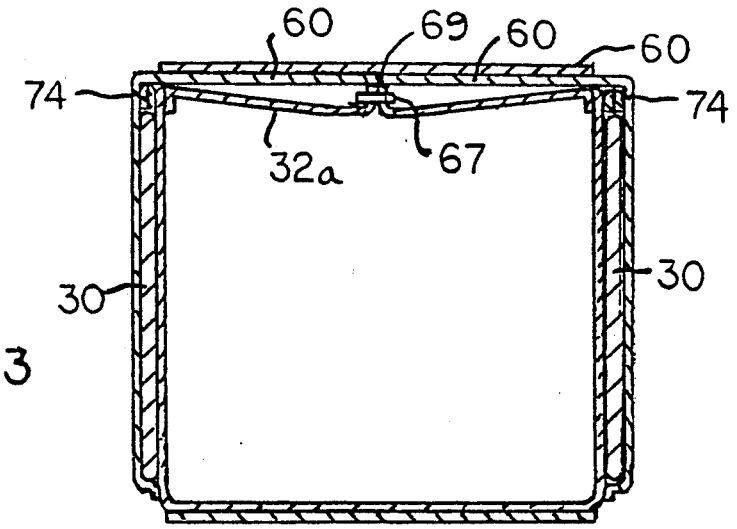
FIG. 13, is a view, taken in the same direction as FIG. 10, but showing the container in a closed position.

FIG. 13, is a view, taken in the same direction as FIG. 10, but showing the container in a closed position.

After the container has been filled with flowable material, the flexible sleeve material can be closed with a flexible tie member 67, as shown in FIG. 13. The excess flexible material, can then be stuffed downwardly into the container to the condition depicted in FIG. 13.

In the FIG. 10 construction, the outer layer 26, of each container side wall, has an upper edge 27. A flexible flap 60, is integrally joined to each outer layer 26, at its upper edge 27, whereby each flap can be swung from an open position, extending downwardly along the outer surface 61, of the container side wall, to a closed position, extending horizontally inward, toward the container central axis 62. In FIG. 10, two of the flaps 60, are shown in intermediate positions. Each flap can be swung to its open position, as indicated by arrow 63, or to its closed position, extending horizontally inward, toward the container central axis 62, as shown in FIG. 13.

The container shown in FIG. 10, has four upstanding side walls, arranged at right angles to each other, so that the container has a cubic configuration. Each container side wall has an integral flap 60. Two of the flaps 60, are swingable towards each other, in order to extend in a horizontal plane, immediately above the collapsed sleeve 32a, as shown in FIG. 13. The other two flaps are then swingable, at right angles, to the plane of the paper in FIGS. 10 and 13, so as to overlie the first-mentioned flaps. The various flaps are dimensioned so that when the flaps are swung to their closed positions, as shown in FIG. 13, the free edge 69, of the flaps abut together.

FIG. 11, shows the relative positions of the four flaps, when the four flaps are in their closed conditions. The two visible flaps have free edges abutting at 69a. The free edges of the two concealed flaps abut together at 69b. Each flap 60, has two grommets 70, near its free edge 69. A flexible tie element 72, can be extended through the grommet openings on the abutting flaps 60, to tie the flaps together. As shown in FIG. 11, two of the tie elements 72, are concealed by the other overlying flaps.

The primary function of the four flaps 60, is to provide transverse rigidity to the bag-like container. As viewed in FIG. 11, two of the tie elements 72, cause the two visible flaps to be drawn toward each other, as indicated by arrows 71. The other two tie elements 72, draw the two concealed flaps toward each other, as indicated by arrows 73. The four flaps are in horizontal tension, such that the bag-like container is rigidified against sidewise bulge, shift, or toppling over.

FIG. 12, shows in plan, the blank, or pattern, that can be used to form the bag-like container of FIG. 10. Two rectangular flexible sheets, 75 and 77, or a material impervious to liquid flow, are arranged cross-wise of each other in a cross configuration. The central zone 79, where the two sheets overlap, forms the bottom of the container, i.e., the bottom layers, 38 and 40, as seen in FIG. 10. The four outwardly radiating zones 81, form the inner layers 24, of the container side walls. Adjoining zones 81, are sewn together along side edges 83, to form the bag-like configuration. Each outer layer 26, of a bag side wall is formed by a separate fabric panel 85, that is sewn to a sheet area 81, along three edges of the panel. Each fabric panel 85, extends outwardly beyond the associated sheet area 81, to form a flap 60. At its free edge 69, each flap 60, is turned reversely and sewn to the flap face to provide a reinforced edge. The various grommets 70, are affixed to the reinforced edge area of the flap.

As shown in FIGS. 10 and 13, a stiffening panel 30, is inserted into each pocket, formed between the inner and outer layers of each container side wall. Each stiffening panel 30, can be releasably retained in its pocket, by means of mating adhesive strips 74, secured to the facing surfaces of layers 24 and 26. Strips 74, are preferably formed of fibrous hook and loop materials, marketed under the tradename VELCRO. Characteristically, such adhesive materials can be pressed together to form a releasable connection therebetween. As shown in FIGS. 10 and 13, the adhesive strips are secured to the mouth areas of the pockets, whereby the stiffening panels 30, are releasably retained in the pockets. The panels can be removed and/or replaced when necessary, or desirable, e.g., for shipment separately, or replacement, should a panel become deformed or cracked.

By way of summarization, the present invention contemplates a collapsible container, wherein the side walls have inner and outer layers, cooperatively forming pockets that are adapted to receive rigid reinforcement panels, whereby the container has vertical rigidity. The outer layer of each side wall has a flexible flap that can be swung inwardly to a horizontal position, overlying the closed container. Flexible tie elements are extended through grommet openings in the flaps, such that the flaps are tied together to give the container a desired transverse rigidity.

In the construction of FIG. 1, the flaps are tied to a separate cover that acts as a rigidifying member for the container. In the construction of FIG. 10, the flaps act as the cover. In both cases, the flaps are tied together to provided structural reinforcement for the bag-like container.

The present invention has been presented in its basic form. It is well within the purview of the present invention to make such changes as would be apparent to those skilled in the arts pertaining thereto. For example, two side wall assemblies could be made integral with, and extending from opposite sides of the bottom, with two further side wall assemblies joined thereto to make the final container. A wide variety of materials are available for the manufacture of the subject container, the material selection being determined by the intended contents to be contained therein. It would further be possible to construct containers of the present invention with more than four sides, an even number of sides being necessary for collapsing the container, to provide a means for contents identification. This could also be accomplished by material color.

The present invention ma be subject to many modifications and changes, without departing from the spirit, or essential characteristics, of the present invention, the scope of which is defined in the appended claims.

The present invention describes a collapsible containment system. Features of the present invention are recited in the appended claims. The drawings contained herein necessarily depict structural features and embodiments of the foldable chair construction, useful in the practice of the present invention.

However, it will be appreciated by those skilled in the arts pertaining thereto, that the present invention can be practiced in various alternate forms and configurations. Further, the previously detailed descriptions of the preferred embodiments of the present invention, are presented for purposes of clarity of understanding only, and no unnecessary limitations should be implied therefrom. Finally, all appropriate mechanical, and functional equivalents to the above, which may be obvious to those skilled in the arts pertaining thereto, are considered to be encompassed within the claims of the present invention.

What is claimed is:

1. A collapsible containment system for handling materials having a non-stable consistency, said containment system comprising:

a container having at least four upstanding side wall assemblies, joined to each other along their adjacent side edges, each said side wall assembly having inner and outer layers of flexible liquid-proof material, said inner and outer layers being joined along three edges thereof, and said three edges defining a pocket there between;

each said inner layer, having a greater vertical length than the associated outer layer, wherein the inner layers, collectively form a loading sleeve;

each said outer layer, having an upper edge, and a flap, swingably attached to each outer layer at its upper edge;

each flap having a first plurality of grommets thereon in a patterned array;

a relatively rigid stiffening member, positioned in each respective pocket of each said side wall assembly;

a bottom wall, joined to a lower edge of each said side wall assembly, so that said bottom wall and said side wall assemblies, collectively, define a material receiving cavity;

a top member, having a second plurality of grommets spaced along the periphery thereof, each said second grommet being aligned with a respective grommet of said first grommets on an associated flap, for attachment of said top member to said flaps;

flexible tensionable ties extendable through said aligned grommets on said flaps and said top member in a looped configuration, wherein the flaps are locked to the top member via said ties;

said flaps having overlapped corners;

said first grommets in near proximity to said overlapped corners; and whereby the tensionable ties act to keep the overlapped corners square, such that a container cubic shape is maintained.

* * * * *